United States Patent [19]

Nakamura

[11] 4,407,375

[45] Oct. 4, 1983

[54] PRESSURE COMPENSATOR FOR ROTARY EARTH BORING TOOL

[75] Inventor: Osamu Nakamura, Tokyo, Japan

[73] Assignee: Tsukamoto Seiki Co., Ltd., Tokyo, Japan

[21] Appl. No.: 293,263

[22] Filed: Aug. 17, 1981

[30] Foreign Application Priority Data

May 29, 1981 [JP] Japan ..... 56-78490[U]

[51] Int. Cl.[3] ..... E21B 10/22

[52] U.S. Cl. ..... 175/228; 384/93; 138/31

[58] Field of Search ..... 175/227, 228, 229; 138/26, 30, 31; 384/93

[56] References Cited

U.S. PATENT DOCUMENTS 2,324,701 7/1943 Herman ..... 138/30
3,221,306 3/1973 Sartor ..... 308/8.2
3,476,195 11/1969 Galle ..... 175/228
4,055,225 10/1977 Millsapps ..... 175/228
4,287,916 9/1981 Sugimura et al. ..... 138/30

FOREIGN PATENT DOCUMENTS 55-139501 10/1980 Japan ..... 138/30

*Primary Examiner*—Ernest R. Purser
*Assistant Examiner*—Joseph Falk
*Attorney, Agent, or Firm*—Wenderoth, Lind & Ponack

[57] ABSTRACT

A pressure compensator installed in the bit body of a rotary earth boring tool to lubricate the bearing surfaces of a rotary cutter and to effect a liquid seal. In order to reduce the number of component parts and to enhance durability, the pressure compensator includes a rubber diaphragm interposed between upper and lower capsule halves that form a spherical space.

3 Claims, 6 Drawing Figures

PRESSURE COMPENSATOR FOR ROTARY EARTH BORING TOOL

BACKGROUND OF THE INVENTION

This invention relates to a lubricant pressure compensator for a rotary earth boring tool.

Various lubricant relief valves for rock bits have been proposed to supply the lubricant to rotary portions of the bits. Examples are disclosed in U.S. Pat. Nos. 3,476,195 and 4,055,225, in which are disclosed flexible pressure compensators. However, these conventional compensators are not constructed of rigid and easily assembled parts. The present invention provides a novel structure of a lubricant pressure compensator in which rigid and easily assembled parts, that is, upper and lower capsule halves and a diaphragm member, are inserted into the lubrication reservoir to form a substantially spherical space so as to achieve an efficient and sensitive action of the movable member within a tough and strong compensator.

SUMMARY OF THE INVENTION

In accordance with a feature of the invention, the pressure compensator comprises an upper capsule half, a lower capsule half, and a diaphragm member. The upper and lower capsule halves each have respective hemispherical cavities so as, when the capsule halves are combined, to form a substantially spherical space. The diaphragm member is so interposed between the upper and lower capsule halves as to divide the substantially spherical space into two portions. In one aspect of the invention, good results are obtained with a diaphragm member comprising an oil-resistant rubber such as a nitrile rubber compound. In other aspects of the invention, a reinforcing ring made of a hard material such as stainless steel is provided in the rim portion of the diaphragm member, and/or a valve member made of a hard material such as stainless steel is provided in the central portion of the diaphragm member.

BRIEF EXPLANATION OF THE DRAWINGS

Other objects and features of the present invention will become apparent from the following description and the accompanying drawings in which.

DETAILED EXPLANATION OF THE INVENTION

Figure 1:
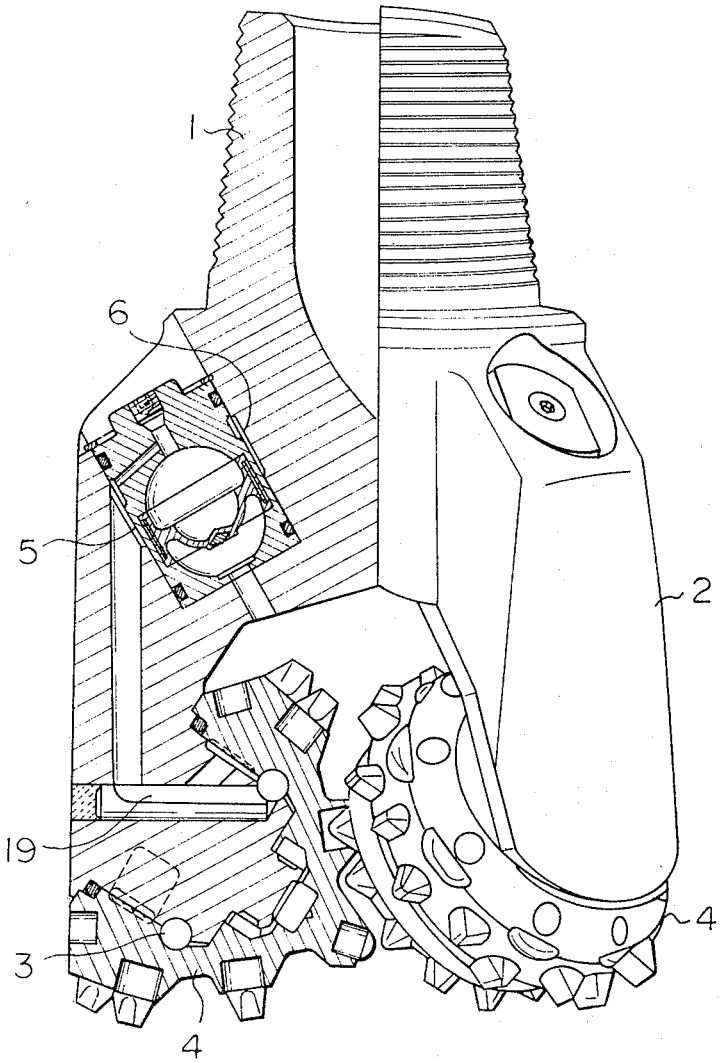
FIG. 1 is a side elevational view, partially in section, illustrating a portion of an earth boring drill bit incorporating the pressure compensator of the present invention.
Figure 2:
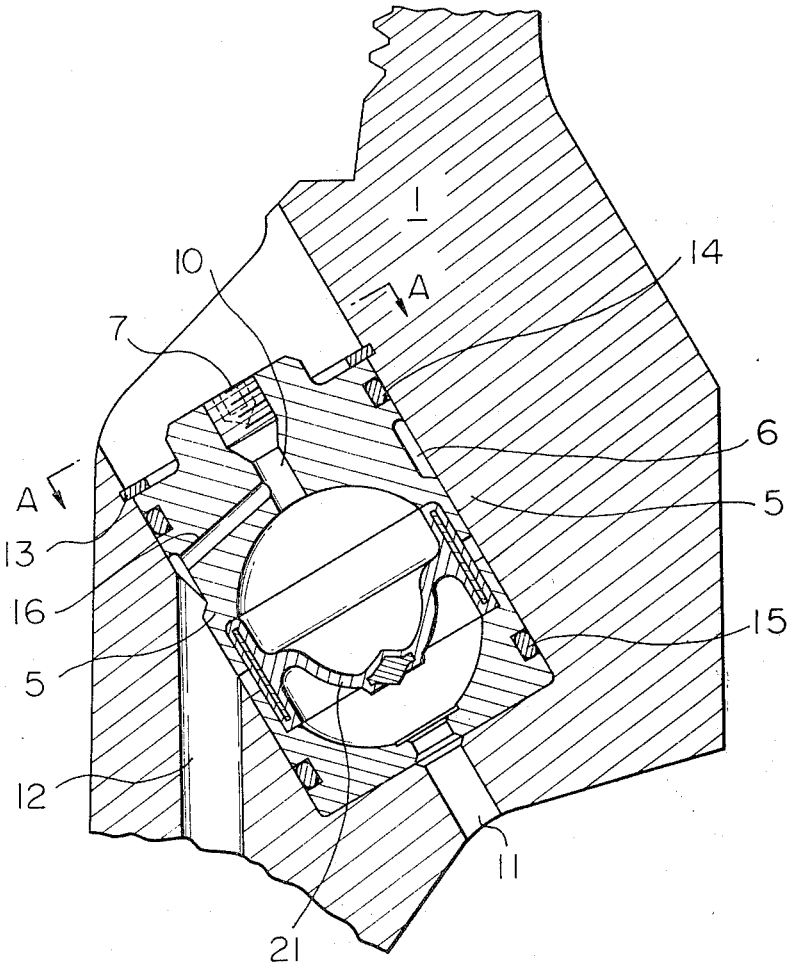
FIG. 2 is an enlarged sectional view showing a portion of the pressure compensator depicted in FIG. 1.
Figure 3:
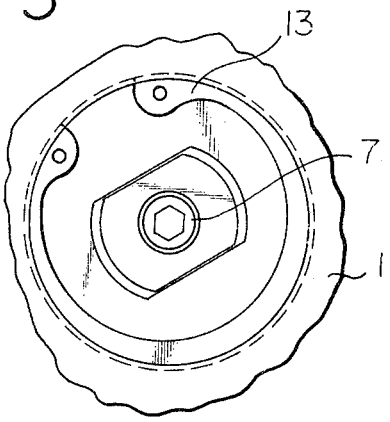
FIG. 3 is a plan view as seen looking in the direction of the arrows A—A in FIG. 2.

Referring to FIGS. 1 through 3, there is shown an earth boring drill bit having a bit body, designated generally by numeral 1. A plurality of bit legs 2 extend from the bit body 1, the end of each bit leg having a bearing portion 3. A rotary cutter is supported for rotation on the bearing portion 3. Accommodated within the bit body 1 is a pressure compensator 5. A lubrication reservoir 6 is bored within the bit body 1. Screwed into the pressure compensator body is a threaded cap 7 which is removed to replenish the lubricant in the reservoir 6. Numerals 10, 12 and 16 denote lubricant passages, 11 a drilling fluid passage, 13 a stop gusset ring, 14 and 15 designate O-ring seals, 19 a ball knock communication groove, and 21 a diaphragm. In accordance with the described arrangement, a lubricant such as grease is fed from the reservoir 6 in the bit body 1 to ball bearing, friction bearing and friction pin portions through the lubricant passage 12 and ball knock communication groove 19. One surface of the diaphragm 21 incorporated within the pressure compensator 5 is in contact with the lubricant pumped in from the passage 10, while the other or opposite surface comes into contact with the drilling fluid, entering from the drilling fluid passage 11, that is circulated within the drilled shaft during the drilling operation. The pressure compensator 5 is completely sealed within the lubrication reservoir 6 through the O-rings 14 and 15 to prevent the intrusion of drilling fluid. This arrangement not only precludes loss of lubricant but also cuts off the flow of the drilling fluid from the lubricant passages to the bearing portions to prevent the drilling fluid and the entrapped foreign matter from invading the cutter portions. More specifically, operating the boring tool under conditions of high temperature, heavy loads or under abnormal pressures invites a variation in pressure between the internally circulating drilling fluid and the lubricant in the reservoir 6 and at the bearing portion 3. In such case the diaphragm 21 responds by so deforming as to absorb the variation in pressure in order to equalize the lubricant pressure at the bearing portion 3 and the drilling fluid pressure. This protects the seal portions against the intrusion of foreign matter and the transmission of abnormal loads.

Figure 4:
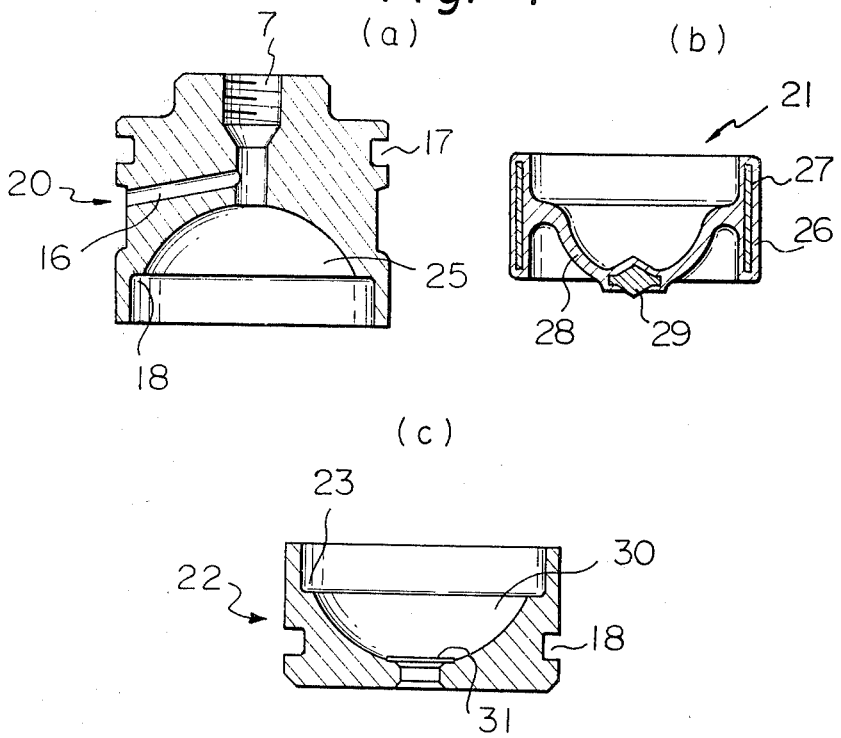
FIGS. 4A, 4B and 4C are sectional side elevations showing an upper capsule half, diaphragm member and lower capsule half, respectively, of the pressure compensator.

The actual structure of the pressure compensator 5 of the invention is shown in greater detail in FIGS. 4A through 4C. It will be appreciated that the pressure compensator 5 comprises three easily assembled parts, namely an upper capsule half 20, preferably made of steel, shown in FIG. 4A, a diaphragm member 21 consisting primarily of an oil-resistant rubber such as a nitrile rubber compound, shown in FIG. 4B, and a lower capsule half 22, also preferably made of steel, shown in FIG. 4C. The upper capsule half 20 is formed to include the passage 16 in such a manner that the passage 16 connects with the passage 10 leading to the oil replenishing cap 7. The passage 16 communicates the lubricant passage 12 with an approximately hemispherical cavity 25, formed in the upper capsule half 20, to receive the lubricant. A sealing groove 17 is formed in the outer periphery of the upper capsule half 20, and a step portion 18 is formed on the surface of the cavity 25. The lower capsule half 22 shown in FIG. 4C has a sealing groove 18' provided on its outer periphery, and is formed to include an approximately hemispherical cavity 30 conforming to the cavity 25 in the upper capsule half. The cavity 30 is provided with a step portion 23 and a valve seat 31. The diaphragm member 21 shown in FIG. 4B has a reinforcing plate 27, made of a hard material such as stainless steel, embedded entirely within the outer rim 26 of the diaphragm member, and a valve member 29, also made of a hard material such as stainless steel, partially embedded within the central portion of a movable cup-shaped member 28, and a diaphragm surface, stretching out from the rim 26.

To install the pressure compensator 5 of the above construction in the bit body 1, the lower capsule half 22, with the O-ring 15 inserted in the sealing groove 18', is introduced into the lubrication reservoir 6. Next, the diaphragm member 21 is inserted into the lubrication reservoir 6 in such a manner that its bottom surface comes to rest snugly on the stepped portion 23 of the lower capsule half 30. The upper capsule half 20, with the O-ring 14 fitted in the sealing groove 17, is subsequently inserted into the lubrication reservoir 6 so that the stepped portion 18 in the cavity 25 of the upper capsule half 20 comes to rest snugly on the surface at the upper end of the diaphragm member 21. Finally, the gusset ring 13, which is made of spring steel or the like, is fit into place to fixedly secure the entire pressure compensator structure. Alternatively, it is possible to pre-assemble the three parts 20, 21, 22 into a unitary block which is then secured within the lubrication reservoir 6. It will be noted that the cavities 25 and 30 in the upper and lower capsule halves together form a substantially spherical space. The arrangement of the pressure compensator is such that the cup-shaped movable member or diaphragm surface 28 will tend to be flattened against the upper or lower hemispherical inner surface of the spherical space owing to the action of pressure acting upon the drilling fluid side of the cup-shaped movable member 28, or upon the lubricant side thereof, respectively. The movable member 28 therefore will not tear even if displaced to the maximum possible extent. The arrangement not only prolongs the life of the movable member but also assures that the pressure compensator will be responsive to slight pressure changes across the diaphragm, which pressure changes may be the result of, say, load fluctuations on the drilling fluid side. Moreover, since the cup-shaped diaphragm surface 28 acts over a large area, even slight movement of the diaphragm causes the movement of a large quantity of lubricant to assure that the bearings at the cutter portion will be fully lubricated for smooth movement at all times. Furthermore, the fact that the pressure compensator comprises only three component parts and can be fabricated in a reduced size allows the assembly to be installed and removed easily and manufactured at comparatively low cost.

As many apparently widely different embodiments of the present invention can be made without departing from the spirit and scope thereof, it is to be understood that the invention is not limited to the specific embodiments thereof except as defined in the appended claims.

What is claimed is:

1. A pressure compensator for being removably installed in the bit body of a rotary earth boring tool, said compensator comprising:

an upper capsule half having a first hemispherical cavity and a step in the edge thereof around the periphery thereof;

a lower capsule half having a second hemispherical cavity and a step in the edge thereof around the periphery thereof;

said first and second capsule halves having the peripheries abutting each other to form a substantial spherical space with a circumferential groove defined by said steps around the joint between said capsule halves; and a diaphragm member of distendable material and having a periphery and a reinforcing ring of hard material embedded in the distendable material and extending around said periphery, said ring embedded in said distendable material being positioned in said groove with the edges facing the respective capsule halves being snugly engaged with the steps, and said diaphragm extending across said spherical space and dividing said space into two portions.

2. A pressure compensator as claimed in claim 1 in which said distendable material is an oil-resistant rubber.

3. A pressure compensator as claimed in claim 1 in which said diaphragm member further has a valve member of a hard material at approximately the center thereof and facing said lower capsule half, and said lower capsule half has a fluid aperture at the center of the hemispherical surface thereof with a valve seat therearound engagable by said valve member when said diaphragm is distended sufficiently to allow said valve member to reach said aperture.

* * * * *